US005192892A

United States Patent [19]

Aono et al.

[11] Patent Number: 5,192,892

[45] Date of Patent: Mar. 9, 1993

[54] PICTURE DISPLAY DEVICE WITH A VIBRATION-PREVENTING ELEMENT

[75] Inventors: Hiroshi Aono; Mitsunori Yokomakura, both of Takatsuki; Keiji Nagata, Hirakata; Takatsugu Kurata, Ibaraki; Kanji Imai, Neyagawa, all of Japan

[73] Assignee: Matsushita Electric Industrial Co., Ltd., Kadoma, Japan

[21] Appl. No.: 576,469

[22] PCT Filed: Dec. 28, 1989

[86] PCT No.: PCT/JP89/01317

§ 371 Date: Nov. 6, 1990

§ 102(e) Date: Nov. 6, 1990

[87] PCT Pub. No.: WO90/07788

PCT Pub. Date: Jul. 12, 1990

[30] Foreign Application Priority Data

| | | | |
|---|---|---|---|
| Jan. 6, 1989 | [JP] | Japan | 1-1546 |
| Mar. 15, 1989 | [JP] | Japan | 1-62462 |
| May 9, 1989 | [JP] | Japan | 1-115344 |

[51] Int. Cl.[5] ..... H01J 29/04; H01J 29/70; H01J 31/12

[52] U.S. Cl. ..... 313/422; 313/269; 313/495

[58] Field of Search ..... 313/251, 268, 269, 344, 313/422, 495; 336/100; 174/42; 73/526, 517 AV, 496, DIG. 1

[56] References Cited

U.S. PATENT DOCUMENTS

| | | | |
|---|---|---|---|
| 1,155,460 | 10/1915 | Barbour | 174/42 |
| 3,246,073 | 4/1966 | Bouche et al. | 174/42 |
| 3,879,780 | 4/1975 | Williams | 174/42 |
| 4,680,424 | 7/1987 | Hawkins | 174/42 |
| 4,714,863 | 12/1987 | Yokoyama et al. . | |
| 4,812,716 | 3/1989 | Miyama et al. . | |
| 4,950,946 | 8/1990 | Van der Wilk | 313/269 |

FOREIGN PATENT DOCUMENTS

| | | | |
|---|---|---|---|
| 90901008 | 10/1991 | European Pat. Off. . | |
| 5010958 | 5/1973 | Japan . | |
| 54-7585 | 1/1979 | Japan | 174/42 |
| 61-230239 | 10/1986 | Japan | 313/422 |
| 61-267240 | 11/1986 | Japan . | |

OTHER PUBLICATIONS

Patent Abstracts of Japan, vol. 10, No. 379 (E-465)(2436) Dec. 18, 1986, JP-A-61 171 035 (Matsushita Electric Ind. Co. Ltd.) Aug. 1, 1986.

*Primary Examiner*—Donald J. Yusko
*Assistant Examiner*—John Giust
*Attorney, Agent, or Firm*—Cushman, Darby & Cushman

[57] ABSTRACT

A picture display device using direct heating type linear cathodes as electron beam sources. Inorganic material vibration prevention elements having a hole thereon are provided. The linear cathodes penetrate the vibration prevention elements at one end part or both end parts of respective linear cathodes. This damps vibrations occurring at the time when an external force is applied and cuase them to cease rapidly.

21 Claims, 13 Drawing Sheets

PICTURE DISPLAY DEVICE WITH A VIBRATION-PREVENTING ELEMENT

TECHNICAL FIELD

The present invention relates to a picture display device using direct heating type linear cathodes as electron beam sources.

In more detail, the present invention relates to vibration prevention means of linear cathodes in a picture display device which comprises a front-face glass envelope whose inside surface is coated with a fluorescent material, a rear-face envelope counterfacing to said front glass envelope, and in a space sandwiched by the above-mentioned rear-face envelope and the above-mentioned front-face glass envelope, a back electrode composed of one conducting plate, a plural number of linear cathodes, an extraction electrode, signal electrodes, a focusing electrode, horizontal deflection electrodes and vertical deflection electrodes, respectively composed of one or a plural number of conducting plates.

BACKGROUND ART

Heretofore, color television picture display devices have mainly used cathode-ray tubes. Cathode-ray tubes have excessively large depth in comparison with their screen face sizes. Hence it has been impossible to make a flat type television receiver using a cathode-ray tube. To overcome this problem, developments of display devices of various types as for the flat-type display device, such as an EL (electroluminescence) display device, plasma display device, and liquid crystal display device, have been developed. None of them can offer satisfactory performance in brightness, contrast, or color reproducibility. Then, aiming at obtaining displays of color television pictures on a flat-type device by employing electron beams which is capable of producing as high quality pictures as an ordinary cathode-ray tube can offer, there have already been picture display devices wherein a picture on its screen was divided into an array of segments of matrix arrangement without leaving blank spaces therebetween and a fluorescent screen of each segment was lit by each electron beam belonging thereto which was deflected and scanned by an adequate means, thereby as a whole, a color television picture was constructed. In the following, referring to the drawings, the above-mentioned picture display device of prior art is elucidated.

FIG. 1 shows an internal constitution of a picture display device of this prior art. In FIG. 1, numeral 101 is a back electrode, numeral 102 represents—therefor linear cathodes as electron beam sources, numeral 103 is an electron beam extraction electrode, numeral 104 are signal electrodes, numerals 105 and 106 are focusing electrodes, numeral 107 is a horizontal deflection electrode, and numeral 108 is a vertical deflection electrode. These elements are stored in glass envelopes 109 and 110 and the inside of the envelopes are evacuated. The linear cathodes 102 are spanned in the horizontal direction so that they produce electron beams having horizontally uniform distribution, and a plural number of such linear cathodes 102 (here, only four of 102*a* to 102*d* are shown) are provided with an adequate spacing. These linear cathodes 102 are constituted by, for example, coating an oxide cathode material on the surface of tungsten wires. The back electrode 101 is composed of a planar conductive material, which is disposed in parallel with the linear cathodes 102*a* to 102*d*. The extraction electrode 103 counterfaces to the back electrode 101 having linear cathodes 102*a* to 102*d* therebetween, and it is composed of a conducting plate having arrays of through-holes 111 provided in the horizontal direction with an adequate spacing over horizontal lines counterfacing to respective linear cathodes.

Although these through-holes 111 are of circular shape in the present working example, it may be such shapes as oval or rectangular, or slit. The signal electrodes 104 are composed of conducting plates 112 which are oblong in the vertical direction and disposed at positions respectively counterfacing to the through-holes on the extraction electrode 103 with having a required distance, and on respective extraction electrodes, at the positions counterfacing to the through-holes 111 of the extraction electrodes 103, similar through-holes 113 are present. The shape of the through-holes 113 may be oval or rectangular shape, or also slit which is oblong in the vertical direction may be used. The focusing electrodes 105 is composed of a conducting plate having through-holes 114 at the positions respectively counterfacing to the through-holes 113 of the signal electrodes 104. As the shape of through-holes 114, circular or oval shape, or slit may be used. The focusing electrode 106 has slit holes 116 which are extending vertically at the positions of through-holes 114 of the focusing electrode 105. As for the shape of the slit holes 115, circular, oval or rectangular shape may be used. The horizontal deflection electrode 107 is comprised of two conducting comb-shaped plates 116 and 117 which are connected at their end parts and mutually engaged with keeping an adequate spacing over a single plane, and a space 118 formed between conducting plates 116 and 117 are facing to through-slit-holes 115 of the focusing electrode 106. The vertical deflection electrode 108 is, as shown in FIG. 2, comprised of a constitution that two conducting plates 119 and 120 which are connected at their end parts, that is, a constitution that two pieces of comb-shaped conducting plate 119 and 120 are mutually engaged keeping an adequate spacing over a single plane. A screen 121 is constituted by coating, over the inner face of an envelope 109, a fluorescent material layer 122 which emits light by the illumination of electron beams and then by adding a metal-back layer (not shown in the FIGURE) thereonto. And, the above-mentioned extraction electrode 103, signal electrode 104, focusing electrodes 105 and 106, horizontal deflection electrode 107, and vertical deflection electrode 108, are jointed respectively by an insulating adhesive (here, not shown in the FIGURE), thereby an unity electrode block 124 is formed.

On a picture display device constituted as described above, its operation is elucidated below.

First, in order to make the electron emission from the linear cathode 102 easy, it is heated by flowing a heater current. Under the state of heating, the back electrode 101, by impressing adequate voltages onto the linear cathodes 102 and the extraction electrode 103, sheet-shaped electron beams are emitted from the surface of the linear cathodes 102. The sheet-shaped electron beams are then divided into a plural number of electron beams by the through-holes 111 of the extraction electrode 103 and they become a plural number of electron beam flows 123. These electron beam flows 123 are adjusted on their passing amounts for respective electron beam flows by the signal electrodes 104 corresponding to the video signal impressed on the signal electrode 104. Next, after the electron beams passing through the signal electrodes 104 are focused and formed by the electrostatic lens effect of the through-holes 114 and 115 of the focusing electrodes 105 and 106, they are deflected by the potential differences given to the adjacent conducting plates 116 and 117 of the horizontal deflection electrode 107 as well as to the adjacent conducting plates 119 and 120 of the vertical deflection electrode 108. Furthermore, a high voltage (for example, 10 kV) is applied on the metal back layer of the screen 121, and hence the electron beams are accelerated up to a high energy and collides with the metal back to make the fluorescent material 122 emit light.

When the television picture screen is divided horizontally and vertically into a matrix shape and an assembly of small segments 125 is formed, by allotting one electron beam which is separated as described above to each of those small segments, and by deflecting and scanning each electron beam only within each small segment, a whole picture can be displayed on the screen. And by controlling the RGB video signals corresponding to respective picture elements by the signal electrodes 104, television moving pictures can be reproduced.

In the constitution as has been described above, for obtaining a high quality picture images all the time, problems described below were present.

As is shown in FIG. 2, the linear cathodes 102*a* to 102*d* are thin wires of a diameter of 10 μm, at their both ends (only one side is shown) their height is limited by a height limit bar 126, and their position in the Y direction is determined by a Y-direction positioning frame body 127. Furthermore, the tension is given at both sides or at one side by springs 128 which are attached to the Y-direction positioning frame body 127.

When vibration is applied to the picture display apparatus including positioned and spanned linear cathodes 102*a* to 102*d*, the linear cathodes 102*a* to 102*d* start vibration containing mainly the simple harmonic vibration as shown in FIG. 3 and keep this vibration until it is damped out. When the linear cathodes 102*a* to 102*d* vibrate, amount of electron beams 123 passing through the through-holes 111 of the above-mentioned extraction electrode 103 varies periodically (not shown), and eventually the brightness on the screen varies periodically, hindering achieving stably a high quality picture image.

Heretofore, as for the prevention means of the vibration of the linear cathodes, there has been a means using cathode electrode control lines as disclosed in a Gazette of Tokkai Sho 50-10958. In the following, explanation is given referring to the drawings.

As shown in FIG. 4 and FIG. 5, cathode control lines 2 are spanned perpendicularly with respect to the spanning direction of linear cathodes 1, and they are held so as to keep a constant distance from the above-mentioned linear cathodes 1. Then, if a certain external force is applied to the structural body, although the above-mentioned linear cathodes start the vibration containing mainly the simple harmonic vibration, when they touch the cathode control line 2, the amplitude is controlled and damped, and thereby the vibration is suppressed. And, the above-mentioned cathode control wires 2 are disposed with predetermined intervals, not with a constant interval, and thereby, as shown in FIG. 4, the resonant vibration due to the second-order vibration of the above-mentioned linear cathode 1 having its nodes at the above-mentioned cathode control lines 2 can be prevented.

Hereupon, in FIG. 4, numeral 3 is an electrode, numeral 4 is a height limit bar for the linear cathodes 1, numeral 5 is a Y-direction positioning frame body for the linear cathodes 1, and numeral 6 are spring elements for spanning the linear cathodes 1 by giving tension thereon.

In the constitution as has been described above, in order to obtain a high quality picture images all the time, there have been problems to be described below.

In a picture display device for the display use, in case that cathode control lines are disposed in the working picture area, the electric field is disturbed and uniform electron beams cannot be produced and hence a uniform picture image cannot be obtained.

And, in case that a plural number of linear cathodes are used, it is very difficult to keep the distances between the above-mentioned cathode control lines 2 and the above-mentioned linear cathodes 1 uniform for respective linear cathodes, and hence the non-uniformity of the above-mentioned distances gives a scatter or dispersion on the above-mentioned vibration prevention function on the linear cathodes 1, causing a variation of the brightness on the screen; and hence a uniform high quality picture image cannot be obtained.

DISCLOSURE OF INVENTION

The present invention is, in considering the problems described above, to offer a picture display device which can display stably a high quality picture image all the time.

The present invention is characterized in that in a picture display device having one or a plural number of linear cathodes, vibration prevention elements composed of inorganic material having a hole thereon are provided, that is, one or plural number of the above-mentioned vibration prevention elements are provided by being penetrated by all the linear cathodes at their one end parts or both end parts. And, in the present invention, the vibration prevention elements are provided to be penetrated by the linear cathodes, and at the same time, stoppers are provided for stopping the movement of these vibration prevention elements into the working picture area.

In accordance with the present invention, by providing the vibration prevention elements by being penetrated by the linear cathodes at their one end parts or both end parts, in case that vibrations of the above-mentioned linear cathodes occurs, immediately the above-mentioned vibration prevention elements start free motions, thereby the vibration energy is absorbed and hence the vibration of the above-mentioned linear cathodes is suppressed. And, since the above-mentioned vibration prevention elements are disposed outside the working picture area, and also they keep their contact to the above-mentioned linear cathodes, there is no dispersion on their vibration prevention function, and hence variation of brightness on the screen does not occur, thereby a stable high quality picture image can be offered.

BEST MODE FOR CARRYING OUT THE INVENTION

Figure 1:
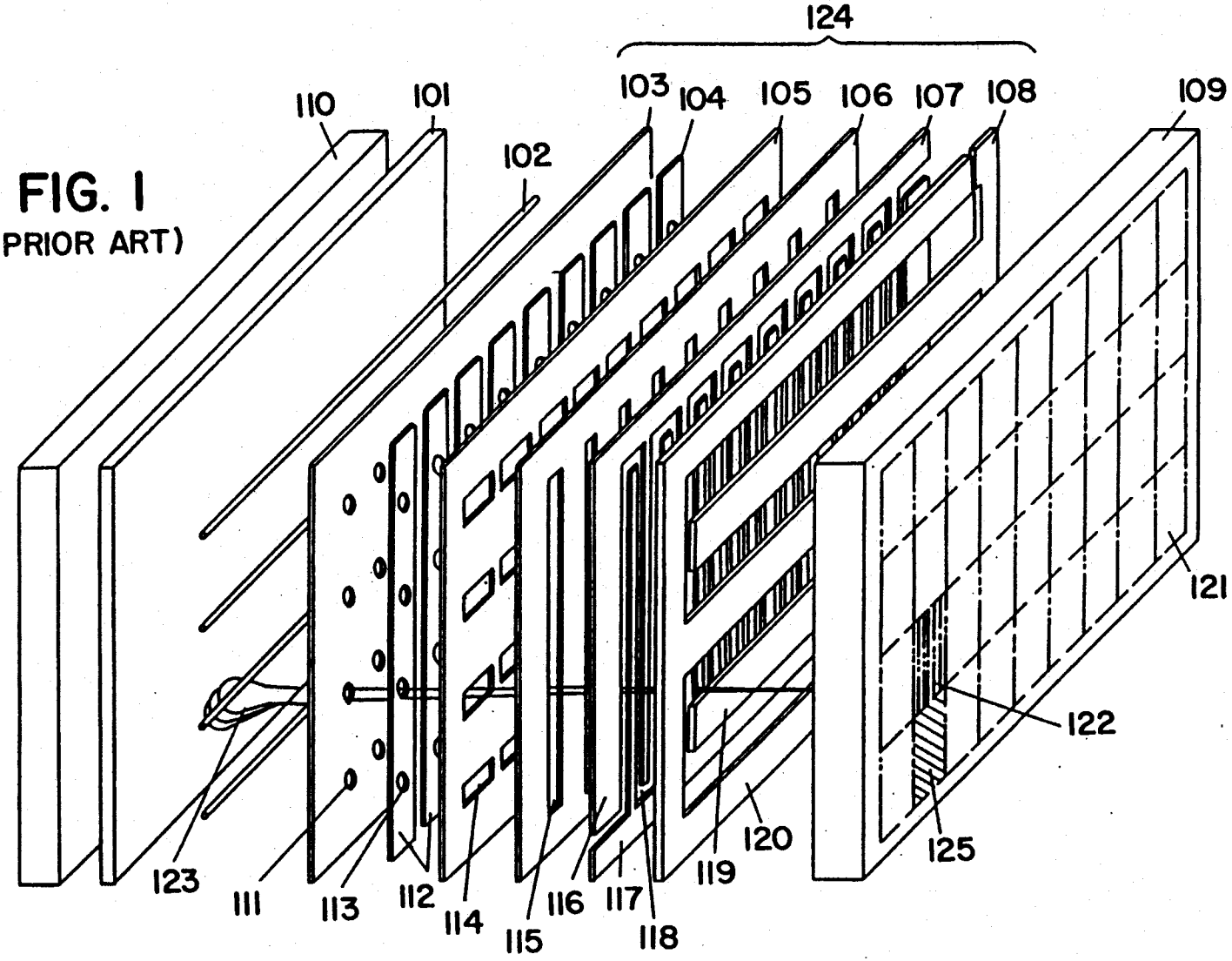
FIG. 1 (PRIOR ART)
FIG. 1 is an exploded perspective view of a picture display device on which the present invention is applied.
Figure 2:
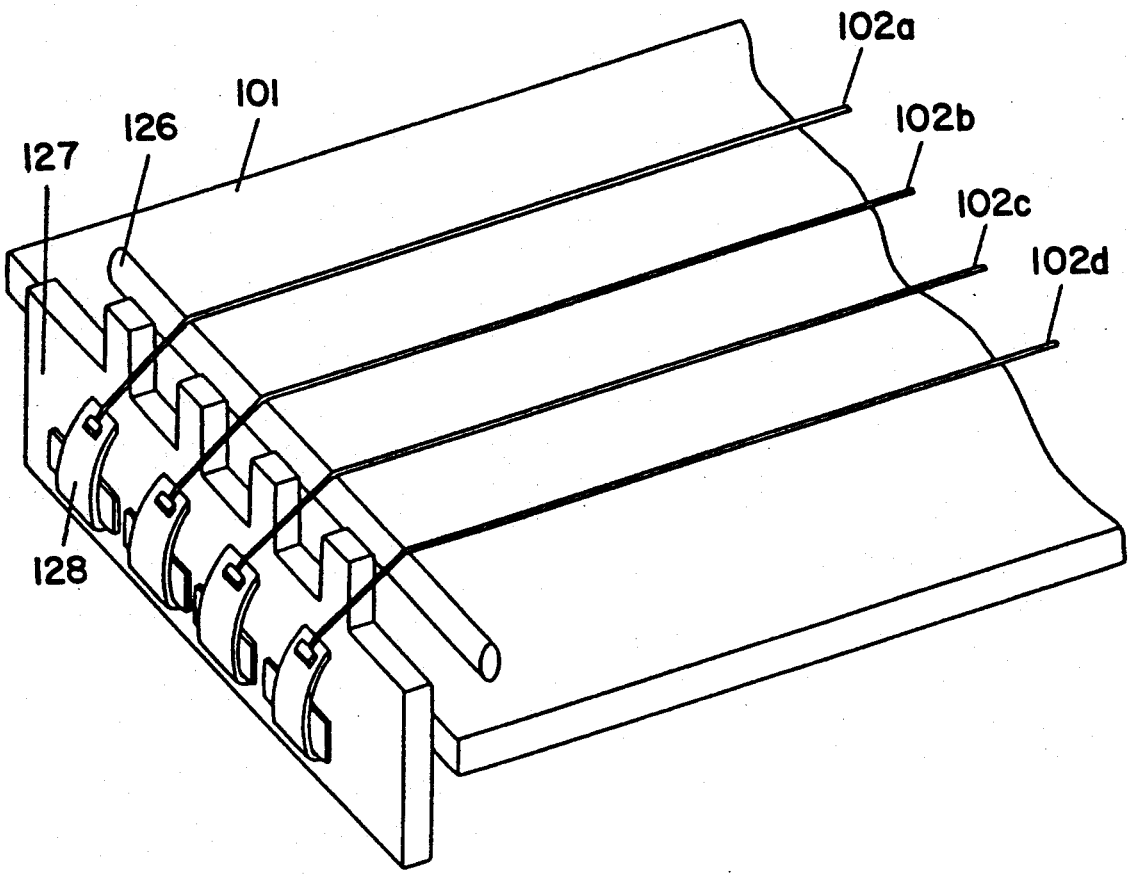
FIG. 2 is a perspective view of a part of spanning of linear cathodes of the above-mentioned picture display device.
Figure 3:
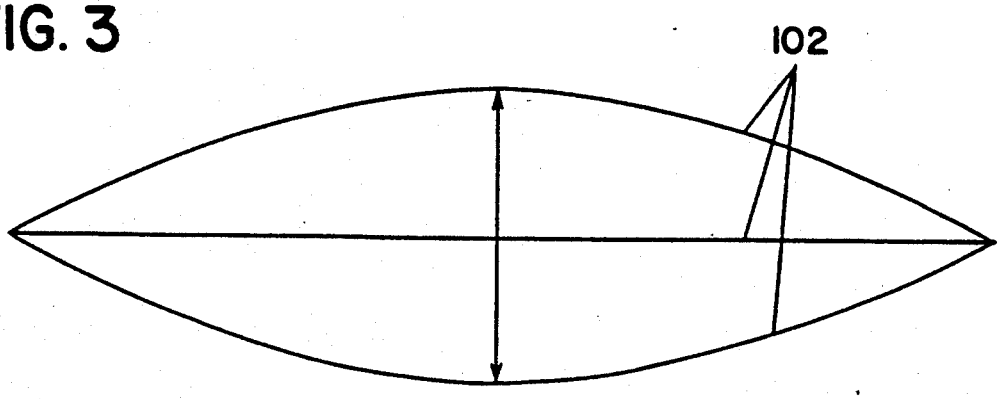
FIG. 3 is a picture showing a vibration mode.
Figure 4:
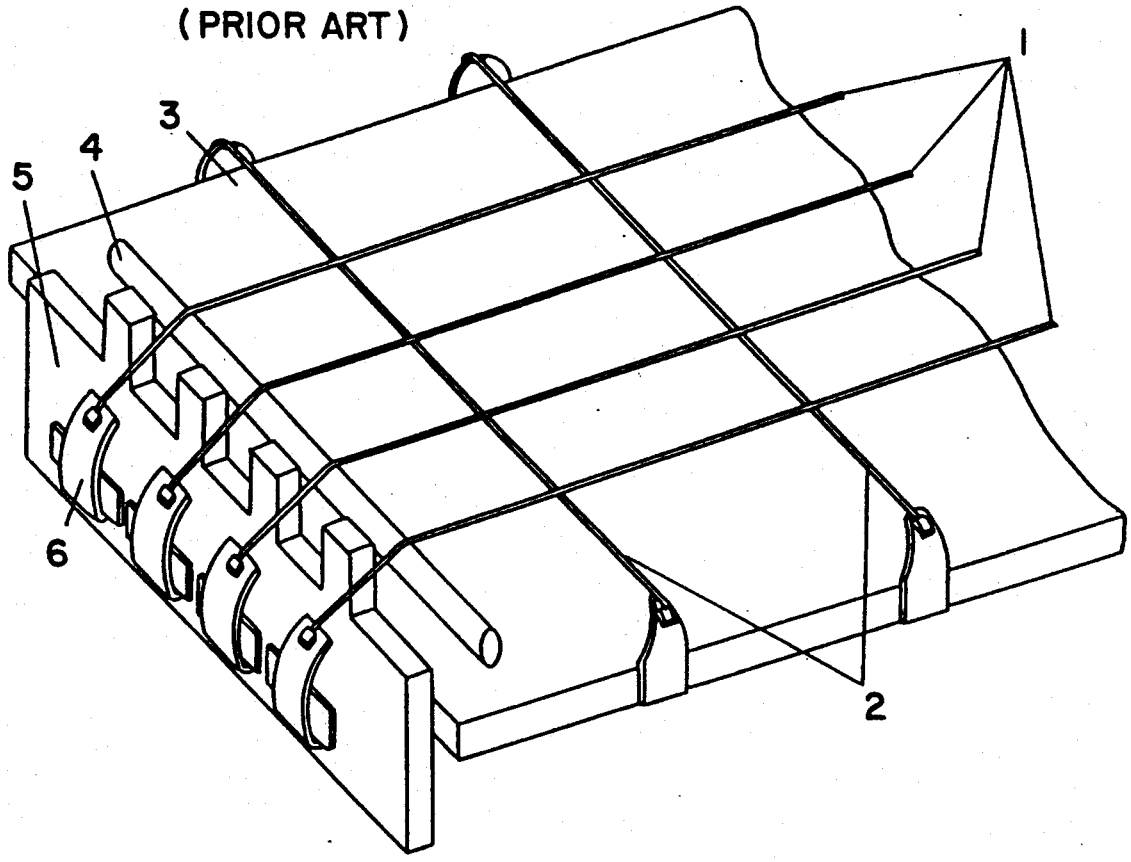
FIG. 4 (PRIOR ART)
FIG. 4 is a partial perspective view showing one example of conventional linear cathode protection means.
Figure 5:
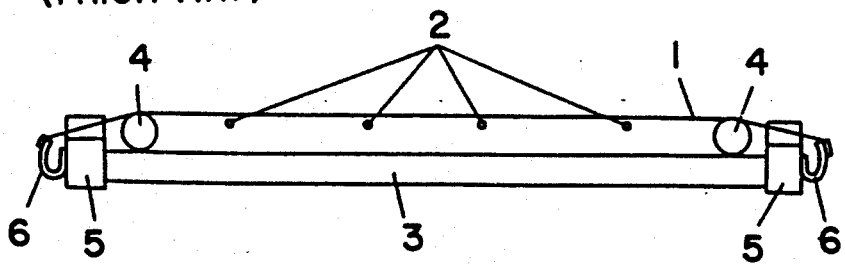
FIG. 5 (PRIOR ART)
FIG. 5 is a partial front view showing one example of conventional linear cathode protection means.
Figure 6:
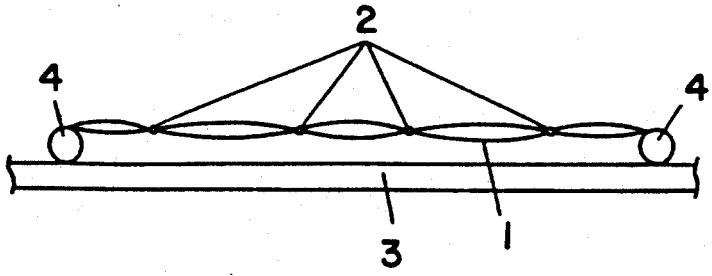
FIG. 6 is a picture showing a vibration mode in the conventional linear cathode protection means.
Figure 7:
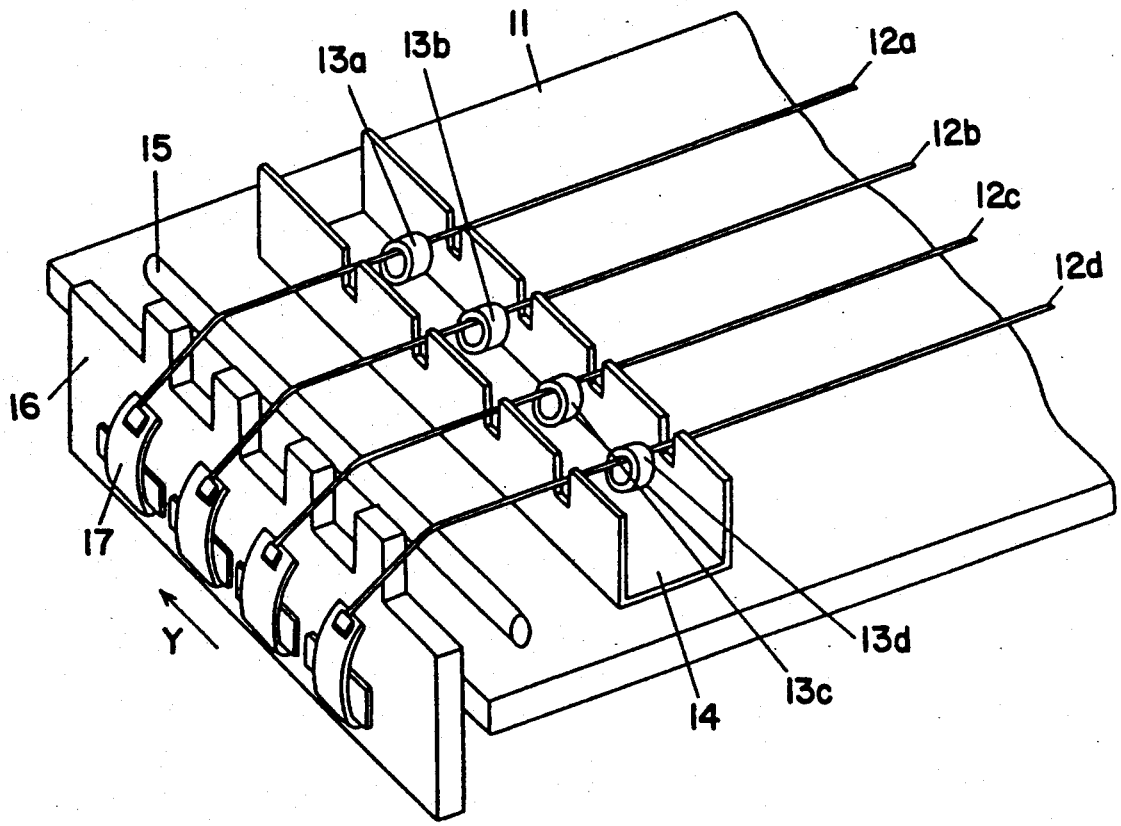
FIG. 7 is an exploded perspective view of principal part of a picture display device in one working example of the present invention.
Figure 8A:
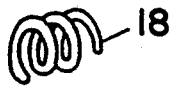
FIGS. 8A to E show a second working example of the present invention which are perspective views showing an installation procedure.
Figure 8B:
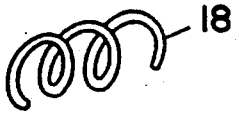
Figure 8C:
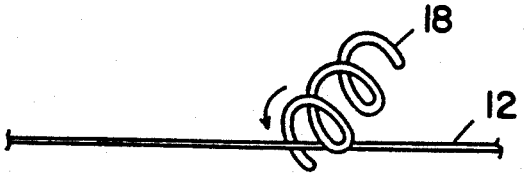
Figure 8D:
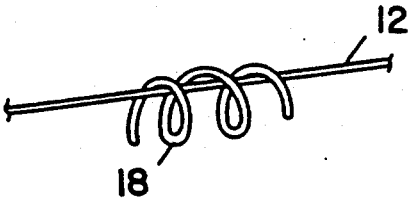
Figure 8E:
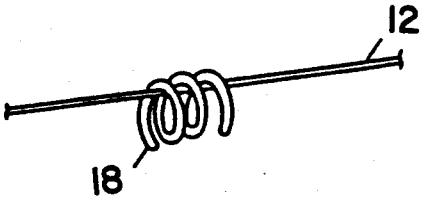
Figure 9A:
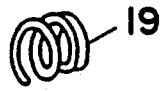
FIGS. 9A to E are perspective views showing a third working example of the present invention.
Figure 9B:
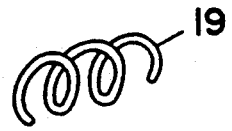
Figure 9C:
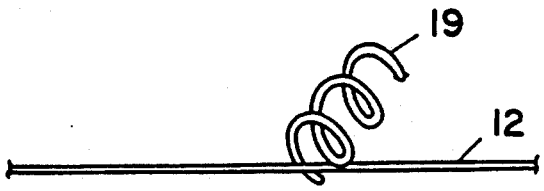
Figure 9D:
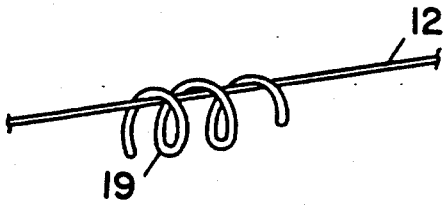
Figure 9E:
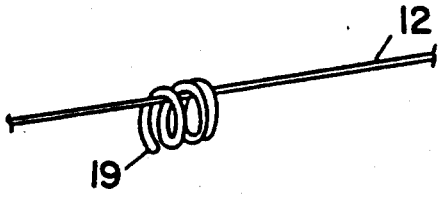
Figure 10A:
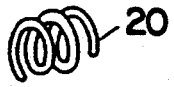
FIGS. 10A to E are perspective views showing a fourth working example of the present invention.
Figure 10B:
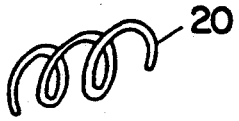
Figure 10C:
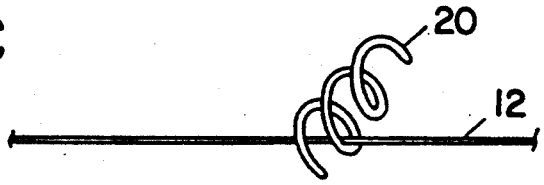
Figure 10D:
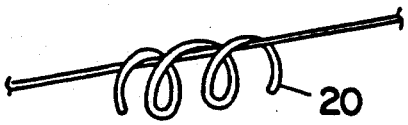
Figure 10E:
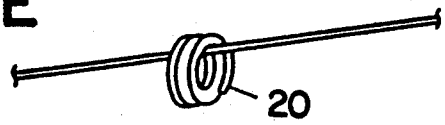
Figure 11A:
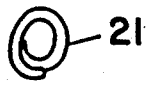
FIGS. 11A to E are perspective views showing a fifth working example of the present invention.
Figure 11B:
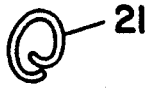
Figure 11C:
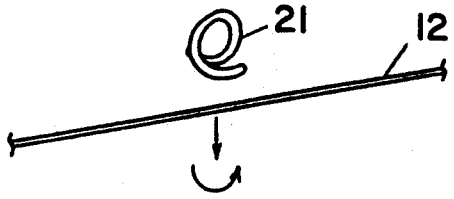
Figure 11D:
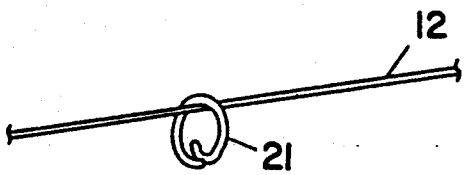
Figure 11E:
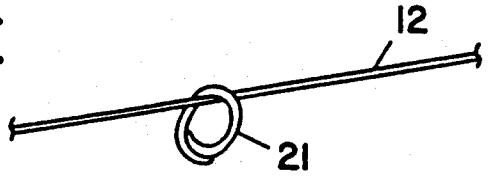
Figure 12A:
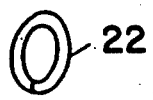
FIGS. 12A to E are perspective views showing a sixth working example of the present invention.
Figure 12B:
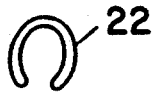
Figure 12C:
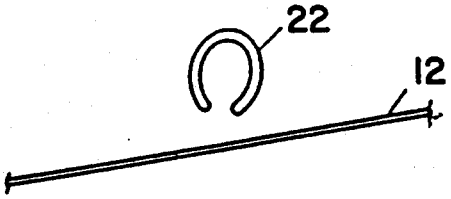
Figure 12D:
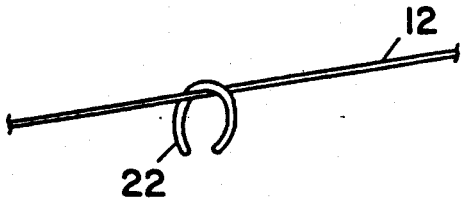
Figure 12E:
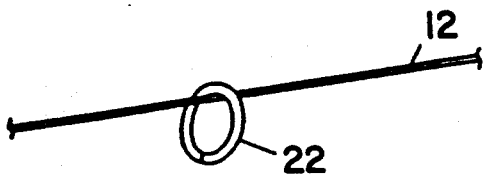

On the picture display device of the first working example of the present invention, explanation is given using FIG. 7. This first working example is devised in a manner that ring-shaped vibration prevention elements 13 (13*a* to 13*d*) made of inorganic material having a hole thereon are provided. The above-mentioned vibration prevention elements 13 are penetrated by all of a plural number of linear cathodes 12 (12*a* to 12*d*) at their one end parts or both end parts. Vibration of the linear cathodes 12 can be prevented by letting the vibration prevention elements 13 move freely responding to the vibration of the linear cathodes 12.

Hereupon, although FIG. 7 shows only the configuration at one end parts of the linear cathodes 12, other end parts have the same configuration. In the FIGURE, numeral 11 is a back electrode, numeral 12 are linear cathodes whose height is limited by height limit bars 15, and which are positioned in the Y-direction by a Y-direction positioning frame body 16. And tension is given on respective linear cathodes 12*a*, 12*b*, 12*c*, and 12*d* by linear cathode springs 17, and thereby they are spanned. And vibration prevention elements 13*a*, 13*b*, 13*c* and 13*d* made of inorganic material having a hole respectively are provided by being penetrated by the above-mentioned linear cathodes 12 outside the working picture area. The hole diameter of the vibration prevention elements 13 is far larger than the diameter of the linear cathodes 12, for example, for a diameter of the linear cathodes 13 of about 20 μm in the hole diameter becomes about 400 μm.

And, sandwiching the above-mentioned vibration prevention elements 13, a frame body 14 having slots in the vertical direction of the above-mentioned linear cathodes 12 is provided. The linear cathodes 12 run through these slots.

Consideration is made below on such a case that an external force such as vibration or shock is applied to the picture display device having linear cathode spanning structure which is constituted as has been described above. Upon application of an external force, the above-mentioned linear cathodes 12 start vibrations at their respective eigen frequencies. At the same time as the start of the vibration, the above-mentioned vibration prevention elements 13*a*, 13*b*, 13*c* and 13*d* which are penetrated and provided on the above-mentioned linear cathodes 12*a*, 12*b*, 12*c* and 12*d* start their free motion, the vibration energy of the above-mentioned linear cathodes 12 is converted into the kinetic energy of the free motion of the above-mentioned vibration prevention elements 13, and the vibration of the above-mentioned linear cathodes 12 immediately damps and ceases. And, although the above-mentioned vibration prevention elements 13 move on the above-mentioned linear cathodes 12 associated with their free motion, their position are limited by the frame body 14 having slots. Therefore, it does not occur that the above-mentioned vibration prevention elements intrude into inside of the working picture area.

Next, explanation is given on the second working example of the present invention referring to the drawings.

FIG. 8 shows a case that the above-mentioned vibration prevention element is a shape-memory alloy on which the shape of a coil is memorized beforehand, and also it shows the structure of attaching of the above-mentioned coil to the above-mentioned linear cathodes 12. FIG. 8A shows a memorized shape of the coil 18 of the shape-memory alloy. Pulling the above-mentioned coil 18 of the shape-memory alloy in the coil axis direction, its wire spaces are expanded as shown in FIG. 8B. The above-mentioned coil 18 of the shape-memory alloy are attached penetrated by twisting it onto the above-mentioned linear cathode 12 so that the above-mentioned all those wire spaces engage therewith. This situation is shown in FIGS. 8C and 8D. Next, by heating the above-mentioned coil 18 of the shape memory alloy, the coil 18 of the shape memory alloy returns its original shape and its wire spaces become small, thereby the drop-off from the above-mentioned linear cathodes 12 can be prevented. This situation is shown in FIG. 8E. On the vibration prevention of the above-mentioned linear cathodes 12 as well as the position limit of the above-mentioned coils 18 of shape memory alloy, they are the same as in the first working example.

Next, the third working example of the present invention is explained referring to the drawings.

FIG. 9 shows a case that the above-mentioned vibration prevention element is a coil 19 of shape-memory alloy on which a part in its peripheral direction is made touched, and also it shows the structure of attaching of the above-mentioned coil 19 to the above-mentioned linear cathode 12. FIG. 9A shows a memorized shape of the coil 19 of the shape-memory alloy on which a part in its peripheral direction is made touched. Pulling the above-mentioned coil 19 of the shape-memory alloy on which a part in its peripheral direction is made touched in the coil axis direction, its wire spaces are expanded as shown in FIG. 9B. The above-mentioned coil 19 of the shape-memory alloy is attached penetrated by twisting it onto the above-mentioned linear cathode 12 so that the above-mentioned all those wire spaces engage therewith. This situation is shown in FIGS. 9C and 9D. Next, by heating the above-mentioned coil 19 of the shape memory alloy, it returns its original shape shown in FIG. 9A. Thereby, a part of the periphery of the coil 19 of shape memory alloy is made touched and its gap is eliminated, and thus the drop-off from the above-mentioned linear cathodes 12 can be prevented completely. This situation is shown in FIG. 9E. On the vibration prevention of the above-mentioned linear cathodes 12 as well as the position limit of the above-mentioned coils 19 of shape-memory alloy, they are the same as in the first working example.

Next, explanation is given on the fourth working example of the present invention referring to the drawings.

FIG. 10 shows a case that the above-mentioned vibration prevention element is a coil 18 of shape-memory alloy, and also it shows the structure of attaching of the above-mentioned coil to the above-mentioned linear cathode 12 after it is reversed. FIG. 10A shows a memorized shape of the coil 18 of the shape-memory alloy. After reversing the above-mentioned coil 18 of shape memory alloy, pulling it in the coil axis direction, its wire spaces are expanded to form a reversed coil 20 of shape memory alloy. This situation is shown in FIG. 10B. The above-mentioned coil 20 of the shape-memory alloy is attached penetrated by twisting it onto the above-mentioned linear cathode 12 so that all the wire spaces engage therewith. This situation is shown in FIGS. 10C and 10D. Next, by heating the above-mentioned reversed coil 20 of the shape memory alloy, on a way of returning to its original memorized shape, spaces of the coil in the peripheral direction is lost, thereby the drop-off from the above-mentioned linear cathodes can be prevented completely. This situation is shown in FIG. 10E. On the vibration prevention of the above-mentioned linear cathodes 12 as well as the position limit of the above-mentioned reversed coil 20 of shape memory alloy, they are the same as in the first working example.

Next, the fifth working example of the present invention is explained referring to the drawings.

FIG. 11 shows a case that the above-mentioned vibration prevention element is a shape memory alloy on which the shape of a coil is memorized beforehand, and also it shows the structure of attaching of the above-mentioned coil 19 to the above-mentioned linear cathode 12 in case that the number of winding is taken to be one or two. FIG. 11A shows a memorized shape of a tightly wound coil 21 of the shape memory alloy whose number of winding is taken to be one or two. Pulling the above-mentioned tightly wound coil 21 of the shape memory alloy in the coil axis direction, its wire spaces are expanded. This situation is shown in FIG. 11B. Then inserting the above-mentioned tightly wound coil 21 of the shape memory alloy into the above-mentioned linear cathode through the above-mentioned wire space, thereby it is attached penetrated. This situation is shown in FIGS. 11C and 11D. On that occasion, since the tightly wound coil 21 of shape memory alloy can be inserted from only one direction without twisting it, an improvement of assemble workability is attained. Next, by heating the above-mentioned tightly wound coil 21 of shape memory alloy, it returns its original shape and thereby spaces between wires are eliminated and hence the drop-off from the above-mentioned linear cathodes 12 can be prevented. This situation is shown in FIG. 11E. Hereupon, it is also possible to use the above-mentioned tightly wound coil 21 of shape memory alloy reversing it. On the vibration prevention of the above-mentioned linear cathodes 12 as well as the position limit of the above-mentioned tightly wound coils 21 of shape memory alloy, they are the same as in the first working example.

Next, the sixth working example of the present invention is explained referring to the drawings.

FIG. 12 shows an attaching structure to that above-mentioned linear cathodes 12 in a case that the above-mentioned vibration prevention element is a shape memory alloy on which the shape of a coil whose both end faces mutually touch is memorized beforehand. FIG. 12A shows a memorized shape of a ring 22 of the shape memory alloy. Pulling the above-mentioned ring 22 of the shape memory alloy in the circumferential direction of the ring, its gap is expanded as shown in FIG. 12B. Then inserting the above-mentioned ring 22 of the shape memory alloy into the above-mentioned linear cathode 12 through the above-mentioned gap between both end faces, thereby it is attached penetrated. On that occasion, since the above-mentioned ring 22 of shape memory alloy can be inserted to be penetrated and attached from only one direction without twisting it, an improvement of assemble workability is attained. This situation is shown in FIGS. 12C and 12D. Next, by heating the above-mentioned ring 22 of shape memory alloy, the above-mentioned ring 22 returns its original shape, and thereby the gap between both end faces is eliminated and hence the drop-off from the above-mentioned linear cathodes 12 can be prevented. This situation is shown in FIG. 12E. On the vibration prevention of the above-mentioned linear cathodes 12 as well as the position limit of the above-mentioned ring 22 of shape memory alloy, they are the same as in the first working example.

The attaching structure to the above-mentioned linear cathodes 12 in case that the above-mentioned vibration prevention element is a coil of spring material on which a part in its peripheral direction is made touched is the same as in FIG. 9. In this case, however, it is necessary to keep giving the above-mentioned coil of spring material a pulling tension in its axial direction during the penetration and attaching processings onto the above-mentioned linear cathodes 12. On the vibration prevention of the above-mentioned linear cathodes 12 as well as the position limit of the above-mentioned tightly wound coils 21 of the shape-memory alloy, they are the same as in the first working example.

The attaching structure to the above-mentioned linear cathodes 12 in case that the above-mentioned vibration prevention element is a ring of spring material on which a part of its periphery is made touched is the same as in FIG. 12. In this case, however, it is necessary to keep giving the above-mentioned ring of spring material a pulling tension in the its peripheral direction during the penetration and attaching processings onto the above-mentioned linear cathodes 12. On the vibration prevention of the above-mentioned linear cathodes 12 as well as the position limit of the above-mentioned ring of spring material 21 of the shape-memory alloy, they are the same as in the first working example.

In case that the above-mentioned vibration prevention element is made of an insulating material or the same material as the above-mentioned linear cathode, it is the same as in the first working example.

In the working examples described above, for the shape memory alloy, Ni/Ti alloy is, for the insulating inorganic material, ceramic is, and for the inorganic material same as that of the linear cathode, tungsten is, used, respectively.

Figure 13:
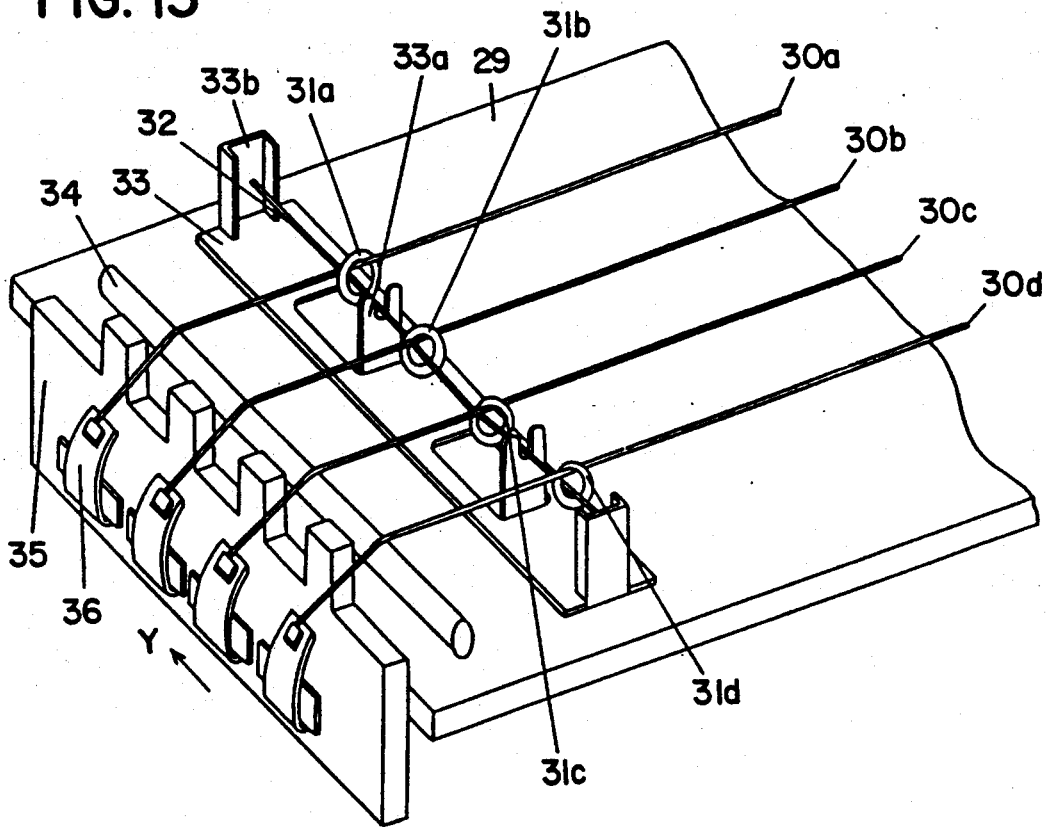
FIG. 13 is a perspective views showing a seventh working example of the present invention.

Explanation is given on a seventh working example of the present invention using FIG. 13. In this working example, one ring-shaped vibration prevention element is penetrated to be attached on a linear cathode, and by letting the above-mentioned ring-shaped vibration prevention element the free movement, the vibration of the linear cathode is suppressed; and by penetrating an insulator wire through the hole of the above-mentioned ring-shaped vibration prevention element in a manner that it crosses perpendicularly with the above-mentioned linear cathode, and further by engaging the above-mentioned insulator wire with a plural number of position limit slots, the position control of the above-mentioned rings is made possible.

In the following, a detailed explanation is given using FIG. 13.

Hereupon, although FIG. 13 shows only the configuration at one end parts of the linear cathodes 30, another end parts have the same configuration. In the FIGURE, numeral 29 is a back electrode. The linear cathodes 30 (30*a* to 30*d*) are limited on their height by height limit bars 34, and further they are positioned in the Y-direction by a Y-direction positioning frame body 35. And tension is given on respective linear cathodes 30*a*, 30*b*, 30*c* and 30*d* by linear cathode springs 36 and thereby they are spanned. And on the above-mentioned linear cathodes 30*a*, 30*b*, 30*c* and 30*d*, ring-shaped vibration prevention elements 31*a*, 31*b*, 31*c* and 31*d* composed of inorganic and heat-resisting material are penetrated and provided. Through all holes of the above-mentioned ring-shaped vibration prevention elements 31*a*, 31*b*, 31*c* and 31*d*, insulator wire 32 is made penetrated in a manner that it runs perpendicularly with respect to the above-mentioned linear cathodes 30. And, the above-mentioned insulator wire 32 is engaged with a plural number of limit slot elements 33*a* provided on insulator wire limit member 33. On both end parts of the above-mentioned insulator wire 32, U-shaped insulator wire drop-off prevention elements 33*b* which are disposed on the above-mentioned insulator wire limit member 33 are provided, and thereby the drop-off of the above-mentioned insulator wire 32 is prevented.

Hereupon, although in this working example, as for the insulator wire 32, a ceramic wire of a diameter of 15 μm is used, there is no restriction on its diameter of on the number of wires.

The case that an external force such as vibration or shock is applied to the picture display device constituted as has been described above is now considered below. Upon application of an external force, the above-mentioned linear cathodes 30*a*, 30*b*, 30*c* and 30*d* start vibrations at their respective eigen frequencies. At the same time as the start of the vibration, the above-mentioned ring-shaped vibration prevention elements 31*a*, 31*b*, 31*c* and 31*d* penetrated and attached on the above-mentioned 30*a*, 30*b*, 30*c* and 30*d* start their free motion, and the vibration energy of the above-mentioned linear cathodes 30 is converted into the kinetic energy of the free motion of the above-mentioned ring-shaped vibration prevention elements 31, and, the vibration of the above-mentioned linear cathodes 30 immediately damps and ceases. And, although the above-mentioned vibration prevention elements 31 move on the above-mentioned linear cathodes 30 associated with their free motion, their positions are limited by the above-mentioned insulator wire 32 which is inserted through the holes of the above-mentioned ring-shaped vibration prevention elements 31 as well as by limit slot elements 33*a*, and thereby intrusions of the above-mentioned ring-shaped vibration prevention elements 31 into the working picture area is prevented. Furthermore, in FIG. 13, although the linear cathode spanning structure is disposed on a horizontal plane, even they are disposed on a vertical plane or on a plane with any angle, for the height of the limit slot elements 33*a*, by setting the slant angle, the effect of the vibration prevention of the above-mentioned linear cathodes 30 as well as the position limit of the above-mentioned ring-shaped vibration prevention elements 31 can be held.

And, in the present working example, although the number of the ring-shaped vibration prevention elements 31 was one, it is also possible to use a plural number of them.

Figure 14:
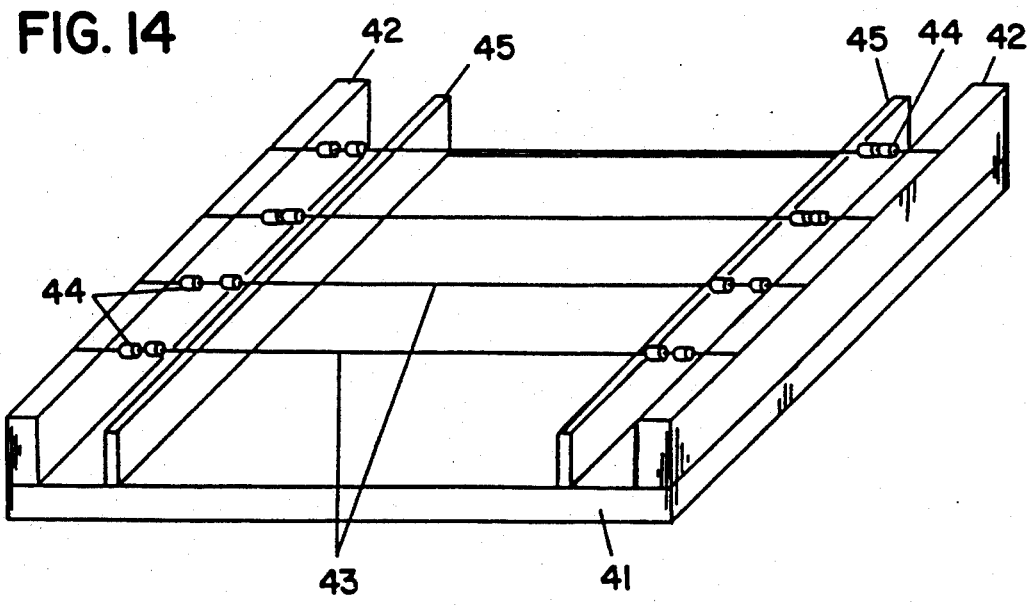
FIG. 14 is a whole perspective view showing an eighth working example of the present invention.

In FIG. 14, an eighth working example of the present invention is shown. In the FIGURE, numeral 41 is a back electrode, and both ends of the linear cathodes 43 are fixed on fixing stands 42. Although not shown in the FIGURE, this fixing means is the same as in the first working example. Numeral 44 are vibration prevention elements, which are composed of a piece of short-cut ultra-thin ceramic insulator tube, and for each linear cathode 43 two thereof are provided on both end parts by inserting them thereon to be attached. Numeral 45 are stoppers for stopping the movement of the vibration prevention elements 44 provided on the back electrode 41, which are for preventing the movement of the vibration prevention elements 44 into the working picture area in association with the vibration of the linear cathodes 44. These stoppers 45 are made in such a height that they do not let the vibration prevention elements 44 pass thereover and also they do not touch the linear cathodes 43.

Its operation and effect are the same as in respective working examples described above.

Figure 15:
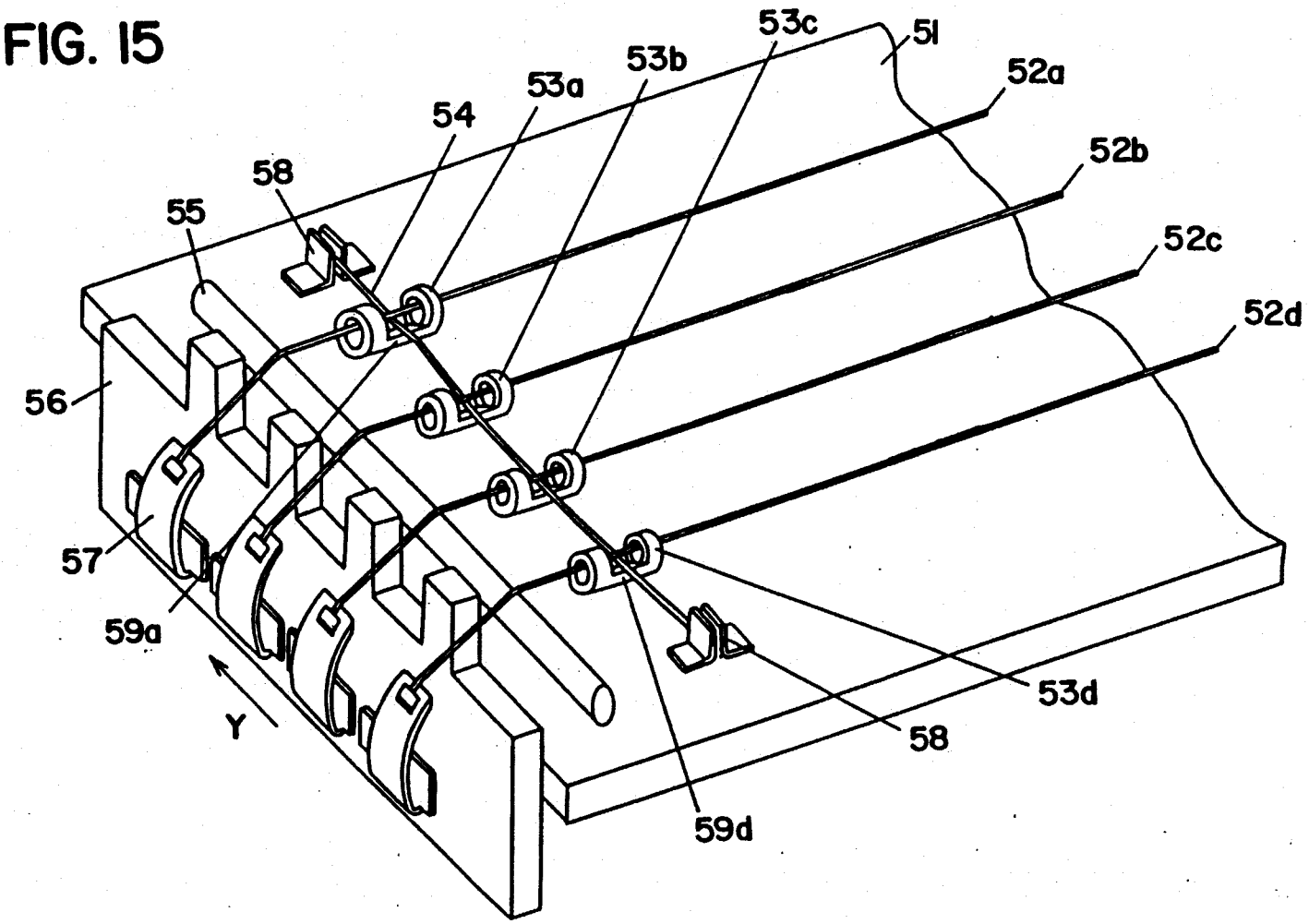
FIG. 15 is a perspective view of a principal part showing a ninth working example of the present invention.

In FIG. 15, a ninth working example of the present invention is shown. This working example is the one that is provided with structural elements which are made of insulating material as the vibration prevention elements and composed of two connected rings, and these vibration prevention elements are penetrated and attached on the both end parts of respective linear cathodes. And, it is devised such that the vibration of the linear cathodes is prevented by inserting wires between a plural number of linear cathodes and connecting parts of two rings in a manner that they positions perpendicularly with respect to the linear cathodes.

Using FIG. 15, its detail is explained. In the FIGURE, numeral 51 is a back electrode, 52*a*, 52*b*, 52*c* and 52*d* are linear cathodes. 53*a*, 53*b*, 53*c* and 53*d* are double-rings which are of ceramics of two rings connected to each other, numeral 54 is an insulator wire made of a glass fiber of a diameter of 50 μm, numeral 55 is a height limit bar, numeral 56 is a Y-direction positioning frame body, and numeral 57 are linear cathode spanning springs. Numeral 58 are fixing stands for fixing the both ends of the insulator wire 54. Hereupon, in FIG. 15, although only the structure of one end part of the linear cathode 52 is shown, another end part has the same structure. The linear cathodes 52 are limited on their height by height limit bars 55, and further they are positioned in the Y-direction by a Y-direction positioning frame body 56. And tension is given on respective linear cathodes 52*a*, 53*b*, 52*c* and 52*d* by linear cathode springs 57 and thereby they are spanned. And holes of those two rings of the double-rings 53*a*, 53*b*, 53*c* and 53*d* are penetrated with the linear cathodes 52*a*, 52*b*, 52*c* and 52*d*. And an insulating wire 54 is inserted and provided between the connecting parts 59*a*, 59*b*, 59*c* and 59*d* of the double-rings 53 and the linear cathodes 52*a*, 52*b*, 52*c* and 52*d* in a manner that they positions perpendicularly with respect to the linear cathodes 52. Both of the height limit bar 55 and the Y-direction positioning frame body 56 are made of insulator material (in the present working example, ceramics is used). Therefore, linear cathodes 52*a*, 52*b*, 52*c* and 52*d* are respectively insulated. And the insulator wire 54 is fixed by at its both end parts by the fixing stands 58.

The case that an external force such as vibration or shock is applied to the picture display device constituted as has been described above is now considered below. Upon application of an external force, linear cathodes 52*a*, 52*b*, 52*c* and 52*d* start vibrations at their respective eigen frequencies. At the same time as the start of the vibration, the above-mentioned double-rings 53*a*, 53*b*, 53*c* and 53*d* penetrated and attached on linear cathodes 52*a*, 52*b*, 52*c* and 52*d* start their free motion, the vibration energy of the above-mentioned linear cathodes 52 is converted into the kinetic energy of the free motion of the above-mentioned double-ring vibration prevention elements 53, and the vibration of the above-mentioned linear cathodes 52 immediately damps and ceases. And, although the above-mentioned double-rings 53 are about to move on the above-mentioned linear cathodes 52 associated with their free motion, their positions are limited by the above-mentioned insulator wire 54 which is inserted between the the double-rings 53 and the above-mentioned linear cathodes 52, as well as by the fixing stands 58, and thereby intrusions of the above-mentioned double-rings 53 into the working picture area is prevented. Furthermore, in FIG. 15, although the linear cathode spanning structure is disposed on a horizontal plane, even they are disposed on a vertical plane or on a plane with any angle, the above-mentioned vibration prevention effect and the position limit effect are kept the same.

Figure 16:
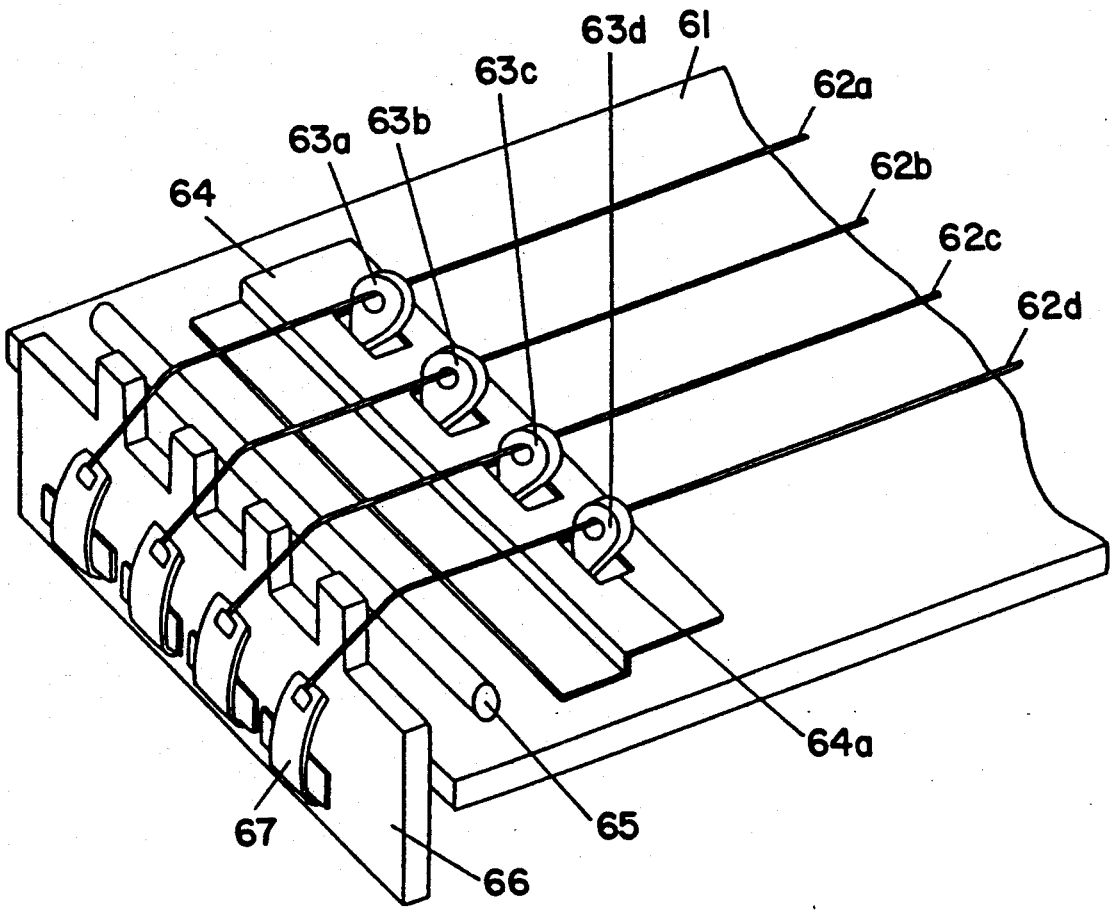
FIG. 16 is a perspective view of a principal part showing a tenth working example of the present invention.
Figure 17:
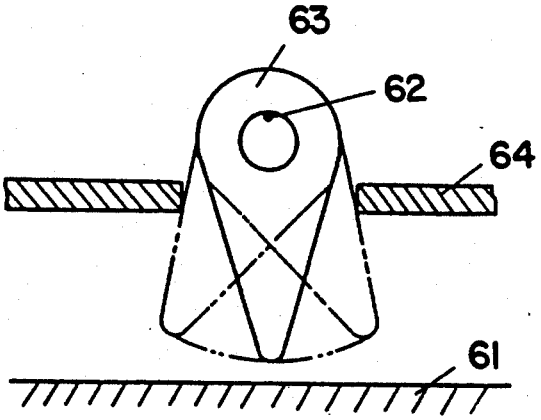
FIG. 17, FIG. 18, and FIG. 19 are cross-sectional views for explaining the function of the vibration prevention elements in the working example of FIG. 16.

In FIG. 16, a tenth working example of the present invention is shown. This working example is the one that is provided with vibration prevention elements made of an insulating material and having a hole at a position eccentric from the center of gravity thereof. At one end part or at the both end parts of respective linear cathodes, the above-mentioned holes of the vibration prevention elements are penetrated by the linear cathodes, thereby the vibration prevention elements are attached.

It is devised that: by letting these vibration prevention elements make the free motion, the vibrations of the linear cathodes can be prevented; and by engaging the above-mentioned vibration prevention elements with respective holes of a limit member on which holes corresponding to the above-mentioned vibration prevention elements are provided with an adequate clearance, the position control of the above-mentioned vibration prevention elements is made possible.

In the following, a detailed explanation is given using FIG. 16 to FIG. 19.

In the FIGURE, numeral 61 is a back electrode, 62*a*, 62*b*, 62*c* and 62*d* are linear cathodes, 63*a*, 63*b*, 63*c* and 63*d* are eccentric rings which ar vibration prevention elements composed of an insulating material and having a hole at a position displaced from the center of gravity thereof (in the working example, ceramics is used), numeral 64 is a limit member, numeral 64*a* are limit holes provided on the limit member 64, numeral 65 is a height limit bar, numeral 66 is a Y-direction positioning frame body, numeral 67 are linear cathode springs. Hereupon, in FIG. 16, although only the structure of one end part of the linear cathodes 62 is shown, another end part has the same structure. The linear cathodes 62 are limited on their height by height limit bars 65, and further they are positioned in the Y-direction by a Y-direction positioning frame body 66. And tension is given on respective linear cathodes 62*a*, 62*b*, 62*c* and 62*d* by linear cathode springs 67 and thereby they are spanned. And respective linear cathodes 63*a*, 63*b*, 63*c* and 63*d*. And the eccentric rings 63 are engaged with respective limit holes 64*a* provided on the limit member 64 and corresponding to respective eccentric rings 63 with an adequate clearance. Both of the height limit bars 65 and the Y-direction positioning frame body 66 are either made of an insulating material (in the working example, ceramics is used). Consequently, those linear cathodes 62*a*, 62*b*, 62*c* and 62*d* are insulated respectively.

Figure 18:
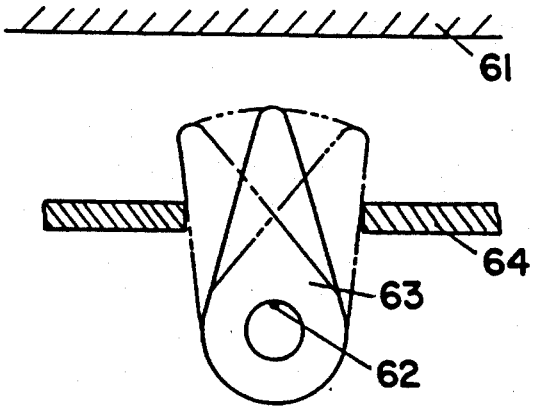
Figure 19:
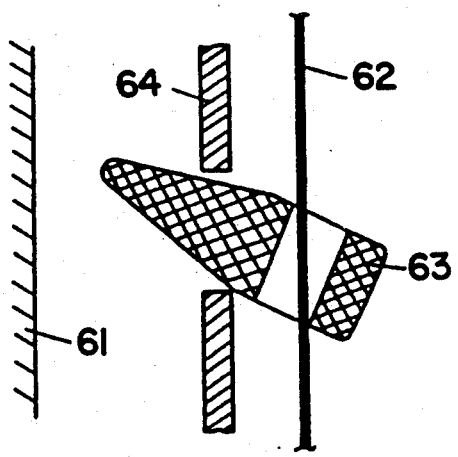

The case that an external force such as vibration or shock is applied to the picture display device constituted as has been described above is now considered below. Upon application of an external force, linear cathodes 62*a*, 62*b*, 62*c* and 62*d* start vibrations at their respective eigen frequencies. At the same time as the start of the vibration, the above-mentioned eccentric rings 63*a*, 63*b*, 63*c* and 63*d* penetrated and attached on the linear cathodes 62*a*, 62*b*, 62*c* and 62*d* start their free motion, and the vibration energy of the above-mentioned linear cathodes is converted into the kinetic energy of the free motion of the above-mentioned eccentric rings 63; and due to the rise up of this free motion of the above-mentioned eccentric rings 63, they collide and slide with the limit holes 64*a* to which they are engaged with the adequate clearance, and thus the kinetic energy of the free motion of the above-mentioned eccentric rings 63 is absorbed to the above-mentioned limit member 64 through limit holes 64*a*; thereby the vibration of the above-mentioned linear cathodes 62 damps and ceases immediately. And, although the above-mentioned eccentric rings 63 are about to move on the above-mentioned linear cathodes 62 associated with their free motion, because they are engaged with the above-mentioned limit holes 64*a* with the adequate clearance, their positions are limited, and thereby intrusions of the above-mentioned eccentric rings 63 into the working picture area is prevented. Furthermore, in FIG. 17, although the linear cathode spanning structure is disposed on a horizontal plane, even they are disposed on a vertical plane or on a plane with any angle as in FIG. 19, the above-mentioned vibration prevention effect and the position limit effect are kept the same. FIG. 18 shows a case that an eccentric ring 63 is attached upside down with respect to the case in FIG. 17.

INDUSTRIAL APPLICABILITY

In accordance with the present invention, by penetratedly attaching vibration prevention elements at one end part or at both end parts of linear cathodes, when vibrations of the above-mentioned linear cathodes take place due to an external force onto a picture display device the above-mentioned vibration prevention elements start their free motions, and hence they absorb the vibration energy and thereby the vibrations of the above-mentioned linear cathodes are suppressed. And, since the above-mentioned vibration prevention elements are placed outside the working picture area and also they are keeping touch with the above-mentioned linear cathodes with a certainty, no scatter or dispersion is present on the vibration prevention effect, and hence no variation on the luminance on the picture screen takes place, making possible to offer a stable high quality picture image.

We claim:

1. A linear cathode apparatus comprising:
a back electrode extending along a first plane;
at least one linear cathode provided along said back electrode in a plane parallel to said first plane;
holding means for holding said linear cathode at a predetermined height above a surface of said back electrode;
at least one vibration prevention element, formed of inorganic materials, each having inner surfaces defining a hole of much larger diameter than an outer diameter of said linear cathode, each said vibration prevention element being freely engaged around each said linear cathode at one end part of said linear cathode, with only a weight of said vibration prevention element holding it on said linear cathode to allow its free movement; and
restricting means for restricting an extent of said free movement of said vibration prevention element, in a direction along which said linear cathode extends, within predetermined limits outside of a working picture area.

2. A linear cathode apparatus in accordance with claim 1, wherein
said at least one vibration prevention element is a shape memory alloy in which a coil shape is memorized beforehand.

3. A linear cathode apparatus in accordance with claim 3, wherein
said coil shape has a tightly-contacted part in the peripheral direction.

4. A linear cathode apparatus in accordance with claim 2, wherein
said vibration prevention elements has a shape having a reversed said coil shape.

5. A linear cathode apparatus in accordance with claim 3, wherein
a number of turns of said coil shape is partially one and partially two.

6. A linear cathode apparatus in accordance with claim 1, wherein
said vibration prevention element is a shape memory alloy of a ring shape whose both end parts tightly contact each other.

7. A linear cathode apparatus in accordance with claim 1, wherein
said vibration prevention element is a coil of spring material including a tightly-contacted part.

8. A linear cathode apparatus in accordance with claim 1, wherein
said vibration prevention element is a ring of spring material whose both ends are tightly contacted with each other.

9. A linear cathode apparatus in accordance with claim 1, wherein
said vibration prevention element is of an insulating material.

10. A linear cathode apparatus in accordance with claim 2, wherein
said vibration prevention element is of the same material as said linear cathode.

11. A linear cathode apparatus in accordance with claim 1, wherein
each of said vibration prevention elements is a ring-shaped element, and
said restricting means comprises an insulator wire, which passes through all of said vibration prevention elements in a perpendicular direction to said direction in which said linear cathode extends and an insulator wire limit member having a plurality of position limit slots which are engaged with said insulator wire.

12. A linear cathode apparatus in accordance with claim 1, wherein
each of said vibration prevention elements is made of insulating material and is constituted by two rings, through which each of said linear cathodes passes, and a connection member for connecting said two rings, and
said restricting means comprises an insulator wire which is passed through all spaces each formed between said two rings in the perpendicular direction to said linear cathodes.

13. A linear cathode apparatus in accordance with claim 1, wherein
each of said vibration prevention elements is formed of insulating material having said hole at an eccentric position from a center of gravity thereof, and
said restricting means comprises a position limit member having one or a plurality of limit holes corresponding to said vibration prevention elements, and
each of said vibration prevention elements is engaged with corresponding one of said limit holes with an adequate clearance therebetween.

14. A linear cathode according to claim 1 wherein
said inner surfaces define a hole substantially twenty times larger in diameter than the outer diameter of said electrodes.

15. A linear cathode as in claim 1 wherein
said restricting means does not contact the linear cathodes.

16. A picture display device comprising:
a front-face glass envelope whose inside surface is coated with a fluorescent material; and
a rear-face envelope-facing in an opposite direction to said front-face glass envelope; and
a structure between said front-face glass envelope and said rear-face envelope, comprising:
a back electrode composed of one conductive plate;
at least one linear cathode provided in a direction along said back electrode;
at least one vibration prevention element of inorganic materials, each having inner surfaces defining a hole of much larger diameter than an outer diameter of said linear cathode, each said vibration prevention element being freely engaged around each said linear cathode at one end part of said linear cathode with only a weight of said vibration prevention element holding it on said linear cathode to allow its free movement;

restricting means for restricting an extent of said free movement of said vibration prevent element, in a direction along which said linear cathode extends, within a predetermined limit outside of a working picture area;

an extraction electrode composed of at least one conductive plate;

a signal electrode composed of at least one conductive plate;

a focusing electrode composed of at least one conductive plate;

a horizontal deflection electrode composed of at least one conductive plate; and a vertical deflection electrode at least one conductive plate.

17. A picture display device in accordance with claim 16, wherein each of said vibration prevention elements includes at least one ring, and said restricting means comprises an insulator wire, which passes through all of said vibration prevention elements in a perpendicular direction to said linear cathodes, and an insulator wire limit member having a plurality of position limit slots which are engaged with said insulator wire.

18. A picture display device in accordance with claim 16, wherein each of said vibration prevention elements is formed of insulating material and is constituted by two rings, through which said linear cathodes passes, and a connection member for connecting said two rings, and said restricting means comprises an insulator wire which passes through all spaces, each formed between said two rings in the perpendicular direction to said linear cathode.

19. A picture display device in accordance with claim 16, wherein each of said vibration prevention elements is made of insulating material having said hole at an eccentric position from a center of gravity thereof, said restricting means comprises a position limit member having one or a plurality of limit holes corresponding to said vibration prevention elements, and each of said vibration prevention elements is engaged with corresponding one of said limit holes with an adequate clearance.

20. A linear cathode according to claim 16 wherein said inner surfaces defining a hole substantially twenty times larger in diameter than the outer diameter of said electrodes.

21. A linear cathode as in claim 16 wherein said restricting means does not contact the linear cathodes.

* * * * *